US006887138B2

(12) United States Patent
Bottema et al.

(10) Patent No.: US 6,887,138 B2
(45) Date of Patent: May 3, 2005

(54) CHEMICAL MECHANICAL POLISH (CMP) CONDITIONING-DISK HOLDER

(75) Inventors: Brian E. Bottema, Austin, TX (US); Larry J. Bustos, Kyle, TX (US); Martin W. Cain, Maxwell, TX (US); Nathan R. Brown, Cedar Park, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 10/601,248

(22) Filed: Jun. 20, 2003

(65) Prior Publication Data

US 2004/0259487 A1 Dec. 23, 2004

(51) Int. Cl.[7] ..... B24B 33/00
(52) U.S. Cl. ..... 451/72; 451/443; 451/444
(58) Field of Search ..... 451/398, 21, 72, 451/443, 444, 56, 285, 286, 287, 288, 289

(56) References Cited

U.S. PATENT DOCUMENTS 5,957,751 A 9/1999 Govzman
6,217,430 B1 * 4/2001 Koga et al. ..... 451/444
6,361,423 B2 3/2002 Gurusamy
6,572,446 B1 * 6/2003 Osterheld et al. ..... 451/24
6,749,494 B2 * 6/2004 Mandall ..... 451/444

* cited by examiner

*Primary Examiner*—Jacob K. Ackun, Jr.
(74) *Attorney, Agent, or Firm*—James L. Clingan, Jr.; Robert L. King

(57) ABSTRACT

A chemical mechanical polishing (CMP) tool holds a conditioning disk that is used to remove impurities from a polishing disk used to planarize surfaces, such as a semiconductor surface. The tool uses an elastic disk that is positioned between a clamp and a gimbal hub that pivotally overlies a gimbal plate. The elastic disk is a polymer material, such as for example polytetrafluoroethylene (PTFE). The elastic disk has a central opening and is radially solid around the central opening. Alignment holes and drive mechanism holes pierce the elastic disk which functions to rotate the tool with minimal friction and provides a liquid seal from CMP fluids. Access holes in the gimbal plate permit easy installation and removal of the individual components. The PTFE disk is strong and durable enough to withstand high torque and provide lengthy operation without maintenance.

22 Claims, 3 Drawing Sheets

CHEMICAL MECHANICAL POLISH (CMP) CONDITIONING-DISK HOLDER

FIELD OF THE INVENTION

This invention relates to equipment for use in chemical mechanical polishing (CMP) in the manufacture of integrated circuits, and more particularly, to the conditioning-disk holder used in CMP equipment.

RELATED ART

Chemical mechanical polishing (CMP) has become a significant aspect of manufacturing semiconductors primarily for its ability to planarize a layer of material that has been deposited on a semiconductor wafer. This process typically involves a polishing pad that spins while the semiconductor wafer is pressed against the polishing pad in the presence of a material that aids in the desired polishing effect. During this process, the surface of the pad collects byproducts of the polishing process. In order to keep the byproducts from accumulating and thereby reducing the abrasive character of the pad, the pad is cleaned by a conditioning disk that is applied to the pad. The conditioning disk is commonly applied during the CMP process so that the pad is continuously kept from accumulating the byproducts of the CMP process. This conditioning disk is itself very abrasive commonly achieved with a diamond abrasive. These conditioning disks are a consumable in that they are expected to lose their abrasive character and have to be replaced. The holder of the conditioning disk, however, is intended to not have to be replaced, or at least rarely so.

One of the problems, however, has been that the conditioning-disk holder has been found to require replacement much more often than is desirable. Because the conditioning-disk holders were intended to not require replacement, they have tended to require significant amounts of time to replace. Also, some of the replacement parts have been very expensive. The expense would be less of a problem if they didn't require replacement.

Thus, there is a need for holders for disk conditioners that require less maintenance and are less expensive to repair.

BRIEF DESCRIPTION OF THE DRAWINGS

The present invention is illustrated by way of example and not limited by the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION OF THE DRAWINGS

In one embodiment a chemical mechanical polishing (CMP) apparatus has a conditioning-disk holder that uses a flexible disk that transfers the flexibly rotating force to the conditioning disk and also operates a seal. The flexible disk is thin and is made from a fluorocarbon. The flexible disk provides for needed flexibility in assisting in providing a substantially uniform force on the conditioning disk while also providing the turning force to cause the conditioning disk to spin. This has simplified the holder for the conditioning disk, making it less expensive and more reliable. This is better understood with reference to the drawings and the following description.

Figure 1:
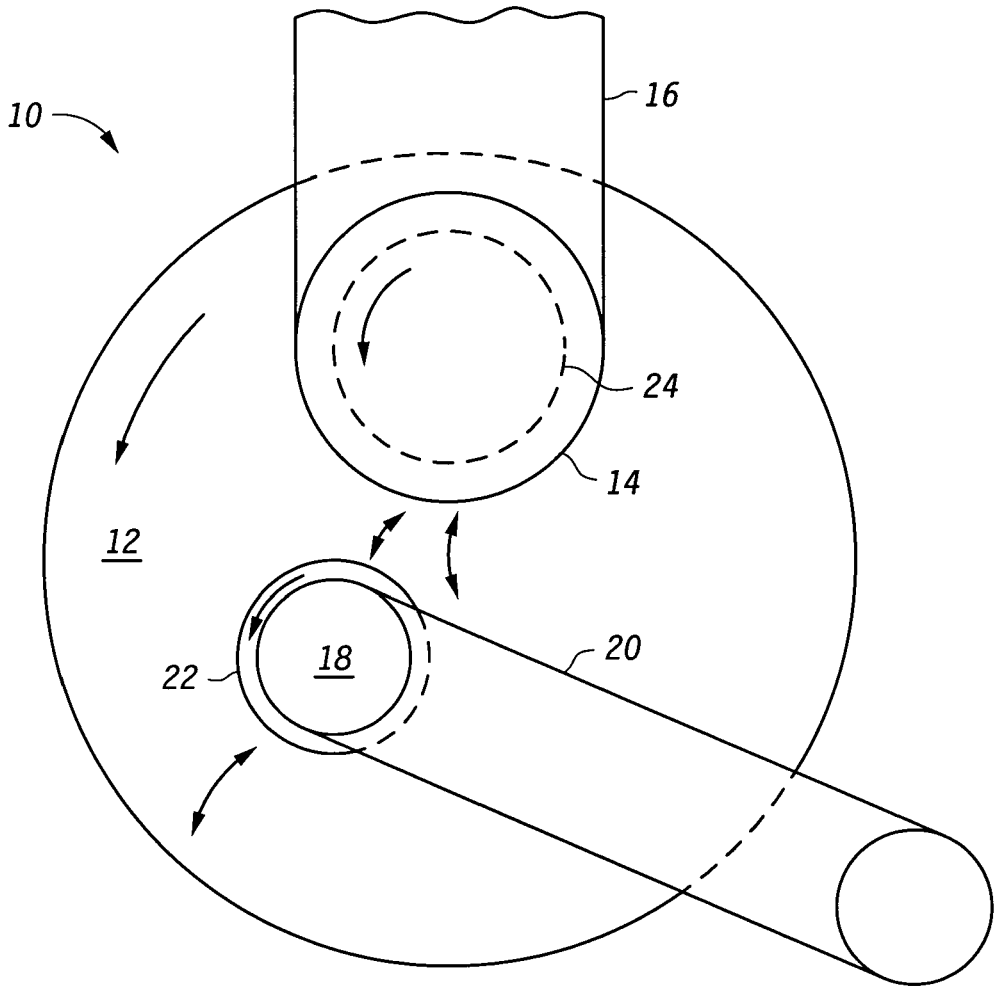
FIG. 1 is diagram of a CMP system having a disk-conditioner holder according to a first embodiment of the invention.

Shown in FIG. 1 is a CMP apparatus 10 comprising a polishing pad 12, a polishing head 14, a polishing arm 16, a conditioning drive 18, a conditioning arm 20, a holder 22 for a conditioning disk, and a semiconductor wafer 24. In operation polishing pad 12 rotates. This rotation is caused by a platen (not shown) on which polishing pad 12 rests. Arm 16 moves wafer 24 back and forth and polishing head 14 spins wafer 24 while pressing wafer 24 against polishing pad 12. Arm 20 moves holder 22 in a rotating action over polishing pad 12 and conditioning drive 18 spins holder 22 while pressing holder 22 downward. Holder 22 holds a conditioning disk 34 (shown in FIG. 2) that is pressed against polishing pad 12 by holder 22. This effectively achieves planarizing a deposited layer on wafer 24 while preventing accumulation of CMP byproducts on pad 12.

Figure 2:
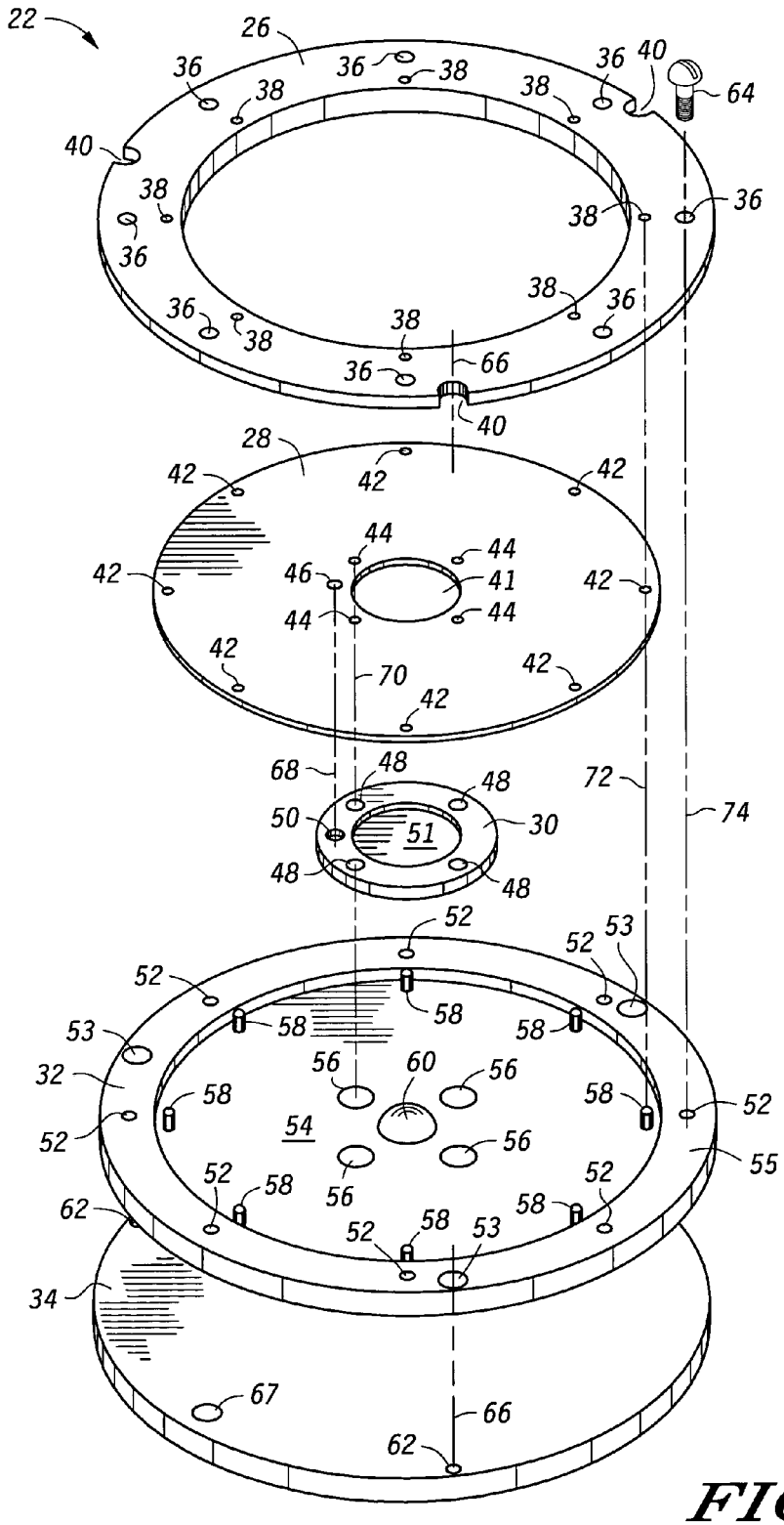
FIG. 2 is an exploded view of the disk-conditioner holder of FIG. 1.

Shown in FIG. 2 is holder 22 in more detail and conditioning disk 34. Holder 22 comprises a clamp ring 26, a flexible disk 28, a gimbal hub 30, and a gimbal plate 32 that is circular. Holder 22, in FIG. 2, is shown with its constituent parts separated vertically. Thus, flexible disk 28 is between clamp ring 26 and gimbal hub 30 and similarly, gimbal hub 30 is between flexible disk 28 and gimbal plate 32. Conditioning disk 34 is attached to holder 22 by gimbal plate 32.

Clamp ring 26 is ring-shaped with a plurality of holes 36 and 38 along the outer portion and notches 40 on the outside surface. In this example, there are 8 evenly spaced holes 36, 8 evenly spaced holes 38, and 3 evenly spaced notches 40. The outer portion of clamp ring 26 has a flange 27, shown in FIG. 3, on the outermost perimeter. The inner perimeter 29, shown in FIG. 3, of ring 26 is thicker than flange 27. The Flange 27 has holes 36 therethrough and the area of the inner perimeter 29 has holes 38 therethrough. Clamp ring 26 is preferably nickel plated stainless steel. The inner dimension of ring 26, i.e. the diameter of the circle defined by inner perimeter 29 is preferably about 8 centimeters.

Flexible disk 28 is a substantially continuous disk of polytetrafluoroethylene (PTFE). Disk has a hole 41 in the center, a plurality of holes 44 arranged radially and relatively near hole 41, and a plurality of holes 42 near the perimeter, and a hole 46 on substantially the same radius as holes 44.

Figure 3:
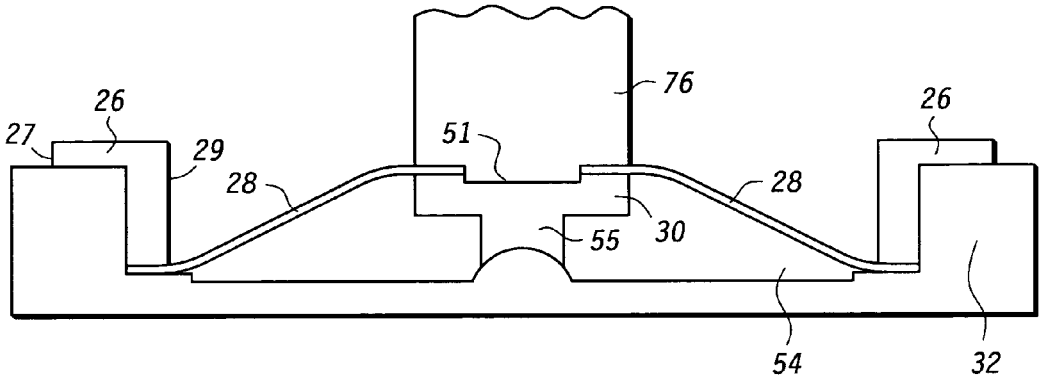
FIG. 3 is a cross section of the disk-conditioner holder of FIG. 1.

Gimbal hub 30 is a disk with a recess 51 in the center that is for gimbal hub centering. A conditioning drive shaft 76, which rotates and is shown in FIG. 3, applies downward force to holder 22 via this recess 51. Gimbal hub 30 also has holes 48 that are on the same radius as holes 44 of flexible disk 28 and a recess 50 that is aligned to hole 46 of flexible disk 28. This alignment between hole 46 and recess 50 is shown with alignment line 68 in FIG. 2. Gimbal hub 30 also has a socket 55 on the underside of the view of FIG. 2 (therefore not visible in FIG. 2) and shown in the cross section of FIG. 3. This socket 55 is in the center of gimbal hub 30. Gimbal hub is preferably nickel plated stainless steel.

Gimbal plate 32 is a disk counterbored to leave a surface 54, which is planar, in the inner area and a shoulder 55 on the outer area. Near the inner perimeter of the shoulder is a plurality of pins 58 radially positioned on surface 54 and protruding upward from surface 54. These pins 58 are on a radius slightly less than the radius on which holes 42 of flexible disk 28 lie. Gimbal plate 32 also has holes 56 that are on the same radius as that of holes 48 of gimbal hub 30 and holes 44 of flexible disk 28. Gimbal plate 32 is preferably nickel plated stainless steel. Gimbal plate 32 further has a centralized elevated region shown as gimbal ball 60 in the center of surface 54. Preferably there is an additional counterbore within surface 54 to leave more flexibility in determining how much the gimbal rises above the surface in relation to the height at which the conditioning drive shaft 74 makes contact. In shoulder 55 are holes 52 and 53. Holes 53 are aligned to notches 40. Holes 52 are threaded and aligned to holes 36 as shown by alignment line 74. Screws attach clamp ring 26 to gimbal plate 32.

Also shown in FIG. 2 is conditioning disk 34 having threaded holes 62 in the same radius as holes 53 gimbal plate 32 and notches 40 of ring 26. These holes 62, holes 53, and notches 40 are aligned as shown by alignment line 66. Thus, conditioning disk 34 is attached by screws at holes 62 to holder 22 via holes 53 and notches 40. Holder 22 can thus be assembled and attached to conditioning drive shaft 76. Conditioning disk 34 also has recesses, for example recess 67, used for alignment. Gimbal plate 32 has corresponding pins (not shown) on the underside thereof that that fit in these recesses.

Shown in FIG. 3 is holder 22 attached to conditioning drive shaft 76. Holder 22 is attached to conditioning shaft 76 prior to conditioning disk 34 being attached to holder 22. Holder 22 is partially assembled prior to being attached to conditioning drive shaft 76. First gimbal hub 30 is placed on gimbal plate 32 and holes 48 are aligned to holes 56. Hole 46 of flexible disk 28 is aligned to recess 50 of gimbal hub 30 and then flexible disk 28 is pushed onto gimbal plate 32 with pins 58 inserted into holes 42. This causes flexible disk 28 to rise in the middle due to holes 42 being on a larger radius than pins 58. This rise is shown in FIG. 3. Notches 40 are aligned to holes 53 and holes 38 are aligned to pins 58. Due to there being 3 notches 40 and 8 holes 38, there is only one position that satisfies both alignment requirements. When holes 38 are aligned to pins 58, holes 36 are aligned to threaded holes 52. After finding this unique alignment solution, clamp ring 26 is pressed onto gimbal plate 32. Clamp ring 26 is attached to gimbal plate 32 with screws, such as screw 64, inserted into holes 36, and screwed into threaded holes 52. Holder 22 is then ready to be attached to conditioning drive shaft 76. In this condition, flexible disk 28 is firmly attached between gimbal plate 32 and clamp ring 26. This attachment makes a good seal that prevents slurry from seeping between clamp ring 26 and gimbal plate 32.

Holder 22 is attached to conditioning drive shaft 76 by aligning a pin (not shown) of conditioning drive shaft 76 to hole 46 and recess 50. This acts to maintain the holder 22 in proper alignment with the conditioning drive shaft 76. With this alignment, screws are inserted through holes 56, holes 48, holes 44 and then screwed into conditioning drive shaft 76 to complete the attachment of holder 22 to conditioning drive shaft 76. Holes 56 are sufficiently large so that the bolts completely pass therethrough. Holes 48 are counterbored from the bottom so that the screws do not protrude below gimbal hub 30. With holes 56 being this large and so aligned, holder 22 can be assembled prior to being mounted to conditioning drive shaft 76. With gimbal hub 30 tightly attached to conditioning drive shaft 76 with flexible disk 28 therebetween, there is both a strong mechanical attachment to flexible disk 28 and a strong seal between gimbal hub 30 and conditioning drive shaft 76.

After holder 22 is attached to conditioning drive shaft 76, conditioning disk is attached to holder 22 by screws through notches 40 and holes 53 and into threaded holes 62.

In operation, flexible disk 28 can flex as conditioning drive shaft 76 changes angle with respect to surface 54. In this way conditioning drive shaft 76 can apply downward pressure evenly while spinning conditioning disk 34. The flexible disk 28, of PTFE, at a thickness of about 0.8 millimeter (mm), provides sufficient flexibility in the vertical direction for proper gimbal operation while retaining sufficient strength and stiffness in the horizontal direction to provide the needed angular force to provide the needed spin. Flexible disk 28 is made of only this PTFE material, which is substantially continuous having only a few holes in it. By being a continuous material of the requisite character avoids the need for any welding, which fatigues under flexing and eventually comes apart. This PTFE material has been found to be very effective for flexible disk 28. Other materials, however, may also be effective. Other materials, especially other polymers, that may be found to be successful are materials that have elasticity and rigidity. One example may be reinforced rubber. In such a case, the thickness would likely need to be increased over that required for PTFE.

In the foregoing specification, the invention has been described with reference to specific embodiments. However, one of ordinary skill in the art appreciates that various modifications and changes can be made without departing from the scope of the present invention as set forth in the claims below. For example, an alternatives for pins 58 include dowel pins, spring pins, threaded screws, and tapered pins. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A chemical mechanical polishing conditioning disk holder comprising:

a circular gimbal plate having a first surface with a centralized elevated region and an opposite second surface for contact with a conditioning disk;

an overlying gimbal hub attached to the circular gimbal plate and formed to mate in close contact with the centralized elevated region to pivot at the centralized elevated region and substantially avoid physical contact with other portions of the circular gimbal plate;

a flexible disk comprised of a polymer material overlying the gimbal hub, the flexible disk having the polymer material radially continuous substantially completely around a central region of the flexible disk to an outside perimeter of the flexible disk; and a clamp overlying the flexible disk, the clamp being connected to the circular gimbal plate for connecting the clamp, the gimbal hub and the flexible disk in an assembly.

2. The chemical mechanical polishing conditioning disk holder of claim 1 wherein the polymer material of the flexible disk is polytetrafluoroethylene.

3. The chemical mechanical polishing conditioning disk holder of claim 1 wherein the polymer material of the flexible disk is a flexible plastic material.

4. The chemical mechanical polishing conditioning disk holder of claim 1 wherein the clamp further comprises a clamp ring having threaded holes, each for receiving a screw to connect the clamp to the circular gimbal plate.

5. The chemical mechanical polishing conditioning disk holder of claim 1 wherein the gimbal hub and the flexible disk further comprise connection holes for permitting connection of the gimbal hub and the flexible disk to a drive mechanism via a connection means.

6. The chemical mechanical polishing conditioning disk holder of claim 5 wherein the connection means further comprise a threaded screw in each of connection holes.

7. The chemical mechanical polishing conditioning disk holder of claim 5 wherein the circular gimbal plate further comprises a plurality of holes positioned in close proximity to the centralized elevated region, the plurality of holes permitting access to the connection holes of the gimbal hub.

8. The chemical mechanical polishing conditioning disk holder of claim 1 wherein the circular gimbal plate further comprises a plurality of pins radially positioned on the first surface, the plurality of pins being aligned to alignment holes in the flexible disk and the clamp to assist in assembly alignment and enhancing fixation of the flexible disk.

9. The chemical mechanical polishing conditioning disk holder of claim 8 wherein the plurality of pins further comprise one of either a plurality of dowel pins, a plurality of spring pins, a plurality of threaded screws, and a plurality of tapered pins.

10. The chemical mechanical polishing conditioning disk holder of claim 1 further comprising:

a rotating drive shaft connected to the flexible disk and the gimbal hub, the rotating drive shaft being connected to the flexible disk and the gimbal hub via connection holes in the flexible disk and the gimbal hub.

11. The chemical mechanical polishing conditioning disk holder of claim 10 wherein the rotating drive shaft is connected to the flexible disk and the gimbal hub by at least one of screws, pins, studs or bolts.

12. The chemical mechanical polishing conditioning disk holder of claim 10 wherein the flexible disk is thinner at portions where the flexible disk is being clamped by the circular gimbal plate and the clamp than at other portions of the flexible disk.

13. A chemical mechanical polishing conditioning disk holder comprising:

plate means having a first surface with a centralized elevated region and an opposite second surface for contact with a conditioning disk;

hub means overlying and attached to the plate means at the centralized elevated region in order to pivot at the centralized elevated region and substantially avoid physical contact with other portions of the plate means;

flexible disk means comprised of a polymer material overlying the hub means, the flexible disk means having the polymer material radially continuous substantially completely around a central region of the flexible disk means to an outside perimeter of the flexible disk means; and clamp means overlying the flexible disk means, the clamp means being connected to the plate means for connecting the clamp means, the hub means and the flexible disk means in an assembly.

14. The chemical mechanical polishing conditioning disk holder means of claim 13 wherein the flexible disk is a disk comprising polytetrafluoroethylene (PTFE).

15. The chemical mechanical polishing conditioning disk holder of claim 13 further comprising:

rotating mechanism means connected to the flexible disk means and the hub means to rotate the assembly.

16. A chemical mechanical polishing holder apparatus, comprising:

a circular planar structure with a rising outer perimeter and an elevated central region;

a gimbal hub tangentially contacting said elevated central region;

a circular elastic element with an outer perimeter and an inner opening having an inner perimeter, wherein said outer perimeter of said circular elastic element fixates said outer perimeter of said circular planar structure to a clamping structure.

17. The chemical mechanical polishing holder apparatus of claim 16 wherein said circular elastic element is polytetrafluoroethylene.

18. The chemical mechanical polishing holder apparatus of claim 16 wherein said inner opening is substantially centralized within said circular elastic element.

19. The chemical mechanical polishing holder apparatus of claim 16 wherein said circular planar structure is a gimbal plate.

20. The chemical mechanical polishing holder apparatus of claim 16 further comprising:

a driving mechanism mounted over said circular elastic element wherein said inner perimeter of said circular elastic element fixates said gimbal hub to said driving mechanism.

21. The chemical mechanical polishing holder apparatus of claim 20 wherein said circular planar structure contains a plurality of holes for accessibility to said driving mechanism.

22. The chemical mechanical polishing holder apparatus of claim 20 wherein said driving mechanism is a shaft.

* * * * *